US012320558B2

(12) United States Patent
Mukherjee et al.

(10) Patent No.: US 12,320,558 B2
(45) Date of Patent: Jun. 3, 2025

(54) $CO_2$ REFRIGERATION SYSTEM WITH ISOCHORIC COMPRESSION

(71) Applicant: Heatcraft Refrigeration Products LLC, Stone Mountain, GA (US)

(72) Inventors: Arijit Mukherjee, Kalyani (IN); Sandesh Ramaswamy, Channarayapatna (IN)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 336 days.

(21) Appl. No.: 18/065,121

(22) Filed: Dec. 13, 2022

(65) Prior Publication Data

US 2024/0191919 A1 Jun. 13, 2024

(51) Int. Cl.

| | |
|---|---|
| ***F25B 31/00*** | (2006.01) |
| ***F25B 39/02*** | (2006.01) |
| ***F25B 40/00*** | (2006.01) |
| ***F25B 41/20*** | (2021.01) |

(52) U.S. Cl.

CPC ..... *F25B 31/00* (2013.01); *F25B 39/02* (2013.01); *F25B 40/00* (2013.01); *F25B 41/20* (2021.01); *F25B 2400/075* (2013.01)

(58) Field of Classification Search

CPC ..... F25B 31/00; F25B 41/20; F25B 39/02; F25B 40/00; F25B 2400/075

See application file for complete search history.

(56) References Cited

U.S. PATENT DOCUMENTS

| | | | | |
|---|---|---|---|---|
| 2007/0163260 | A1* | 7/2007 | Hargreaves | F01K 25/02 60/650 |
| 2018/0195773 | A1* | 7/2018 | Saunders | F25B 5/02 |
| 2018/0231289 | A1* | 8/2018 | Pereira Zimmermann | F25B 49/02 |
| 2019/0072299 | A1* | 3/2019 | Najafifard | F25B 7/00 |
| 2019/0368786 | A1* | 12/2019 | Newel | F25B 40/02 |
| 2019/0376732 | A1* | 12/2019 | Zha | F25B 1/10 |
| 2021/0180851 | A1* | 6/2021 | Zha | F25D 11/04 |
| 2021/0207851 | A1* | 7/2021 | Cole | F25B 41/22 |

* cited by examiner

*Primary Examiner* — Elizabeth J Martin
(74) *Attorney, Agent, or Firm* — Baker Botts L.L.P.

(57) ABSTRACT

A method for operating a refrigeration system includes compressing a refrigerant received from a medium temperature (MT) evaporator unit using a MT compressor unit, and compressing the refrigerant received from a low temperature (LT) evaporator unit using a LT compressor unit. The method includes transferring heat from a portion of the refrigerant provided by the MT compressor unit to a trapped portion of the refrigerant provided by the LT compressor unit using a heat exchanger to produce a pressurized heated refrigerant stream and a cooled refrigerant stream. Pressurizing the refrigerant using isochoric compression (constant volume process) and using waste heat energy increases the overall efficiency of a transcritical CO2 refrigeration system.

17 Claims, 2 Drawing Sheets

$CO_2$ REFRIGERATION SYSTEM WITH ISOCHORIC COMPRESSION

TECHNICAL FIELD

This disclosure relates generally to a refrigeration system. More specifically, this disclosure relates to a $CO_2$ refrigeration system with isochoric compression.

BACKGROUND

Refrigeration systems can be used to regulate the environment within an enclosed space. Various types of refrigeration systems, such as residential and commercial, may be used to maintain cold temperatures within an enclosed space such as a refrigerated case. To maintain cold temperatures within refrigerated cases, refrigeration systems control the temperature and pressure of refrigerant as it moves through the refrigeration system.

SUMMARY

Refrigeration systems may cycle a refrigerant to cool various spaces. For example, a refrigeration system may cycle refrigerant to cool spaces near or around refrigeration loads. In certain installations, such as at a grocery store, for example, a refrigeration system may include different types of loads. For example, a grocery store may use medium temperature loads and low temperature loads. The medium temperature loads may be used for produce, and the low temperature loads may be used for frozen foods.

The present disclosure provides improved refrigeration systems and methods of their operation for cooling various spaces, such as medium temperature and low temperature loads. One improvement provided by the present disclosure is the recognition that the pressure of refrigerant discharged from a low temperature (LT) compressor can be increased using waste heat from refrigerant discharged from a medium temperature (MT) compressor. Transferring the waste heat from refrigerant provided by the MT compressor to the refrigerant provided by the LT compressor reduces energy consumption of the refrigeration system. In some embodiments, the waste heat from the refrigerant provided by the MT compressor is transferred to the refrigerant provided by the LT compressor using isochoric compression, e.g., constant volume compression. The systems and methods provided herein reduce the compression ratio and consume less power leading to energy consumption savings for refrigeration systems.

In an embodiment, the present disclosure provides a refrigeration system comprising a MT evaporator unit configured to receive refrigerant. The MT evaporator unit comprises a MT expansion valve and a MT evaporator. The MT expansion valve is configured to decrease the pressure of the refrigerant and the MT evaporator is configured to cool a MT space. The refrigeration system further comprises a LT evaporator unit configured to receive a portion of the refrigerant. The LT evaporator unit comprises a LT expansion valve and a LT evaporator, where the LT expansion valve is configured to decrease the pressure of the refrigerant and the LT evaporator is configured to cool a LT space. The refrigeration system further comprises a MT compressor unit that receives the refrigerant from the MT evaporator unit. The MT compressor unit comprises at least one MT compressor that is configured to compress the refrigerant. The refrigeration system further comprises a LT compressor unit configured to receive the refrigerant from the LT evaporator unit. The LT compressor unit comprises at least one LT compressor configured to compress the refrigerant. The refrigeration system further comprises a heat exchanger that receives a portion of the refrigerant from the LT compressor unit and a portion of the refrigerant from the MT compressor unit. The heat exchanger is configured to transfer heat from the portion of the refrigerant received from the MT compressor unit to the portion of the refrigerant received from the LT compressor unit thereby producing a heated refrigerant stream and a cooled refrigerant stream.

Certain embodiments of the present disclosure may include some, or none of these advantages. These advantages and other features will be more clearly understood from the following detailed description taken in conjunction with the accompanying drawings and claims.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
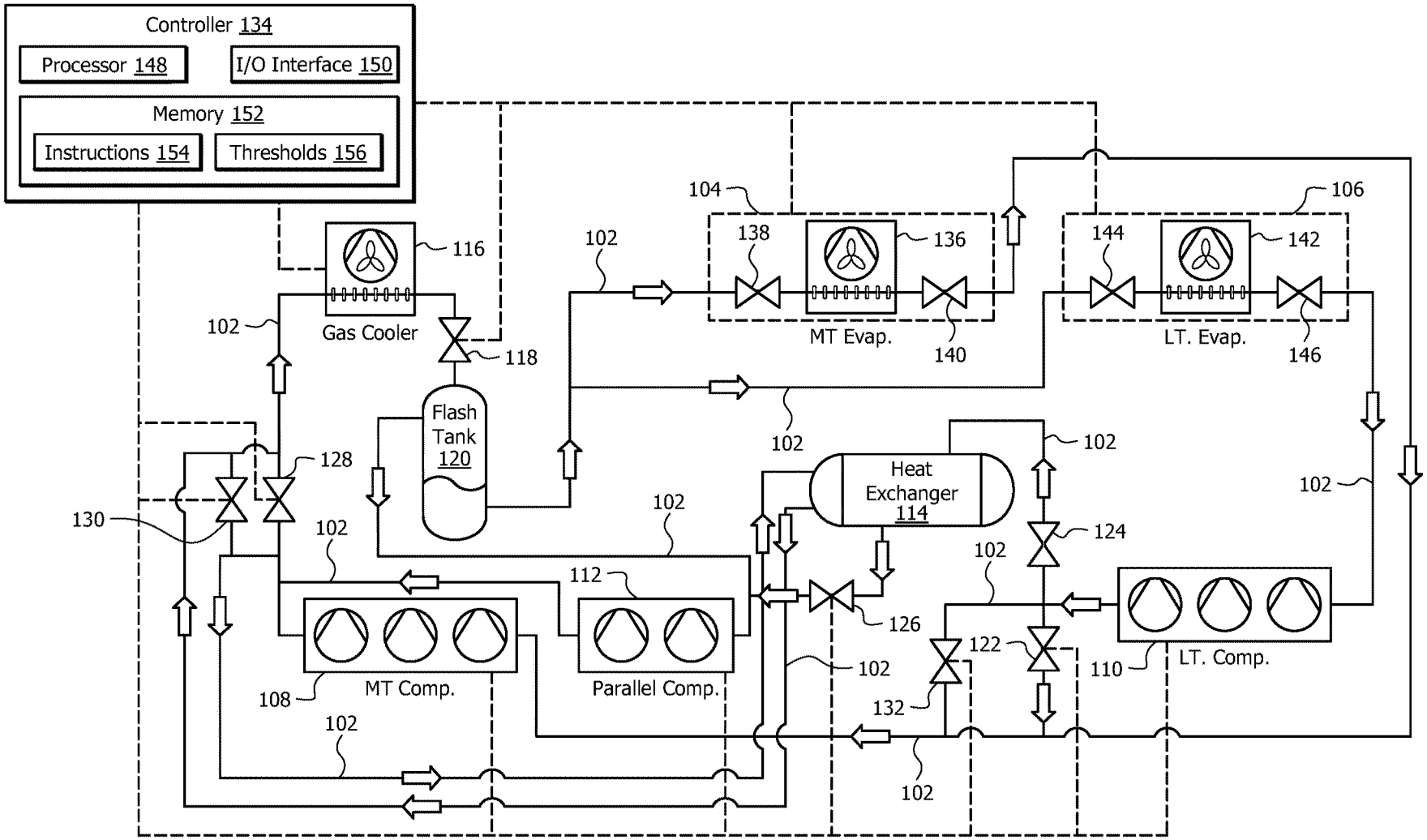
FIG. 1 is a block diagram illustrating an example refrigeration system of the present disclosure.
Figure 2:
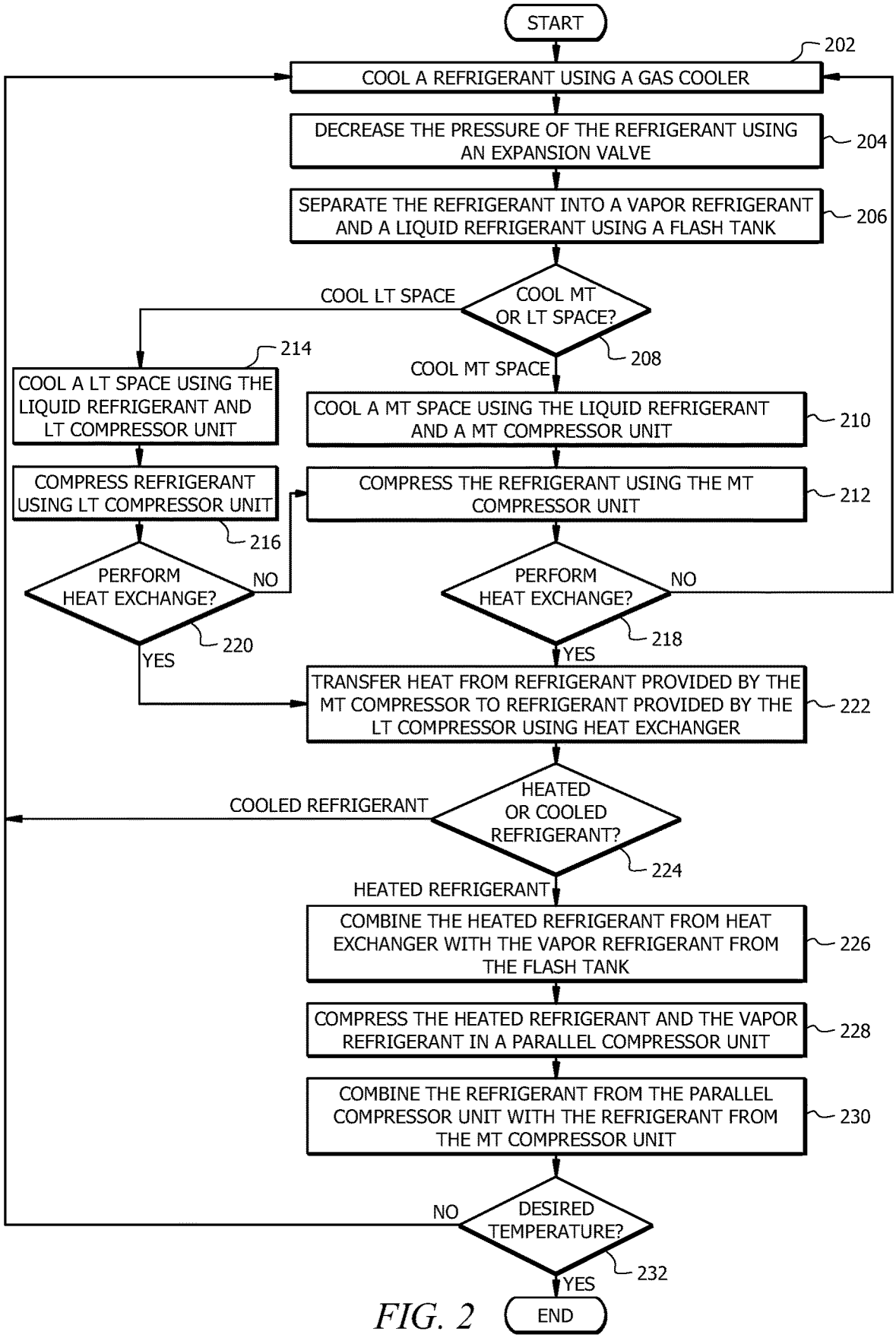
FIG. 2 is a flowchart of an example process for operating a refrigeration system of the present disclosure.

Embodiments of the present disclosure and its advantages are best understood by referring to FIGS. 1-2 of the drawings, like numerals being used for like and corresponding parts of the various drawings.

As described above, the present disclosure provides various improvements to refrigeration systems and methods of their operation. One improvement provided by the present disclosure is the recognition that the pressure of refrigerant discharged from a low temperature (LT) compressor can be increased using waste heat from refrigerant discharged from a medium temperature (MT) compressor. Transferring the waste heat from refrigerant provided by the MT compressor to the refrigerant provided by the LT compressor reduces energy consumption of the refrigeration system. In some embodiments, the waste heat from the refrigerant provided by the MT compressor is transferred to the refrigerant provided by the LT compressor using isochoric compression, e.g., constant volume compression. The systems and methods provided herein reduce the compression ratio and consume less power leading to energy consumption savings for refrigeration systems.

Example Refrigeration Systems

FIG. 1 shows an example refrigeration system 100 according to some embodiments of the present disclosure. The refrigeration system 100 includes a refrigerant conduit subsystem 102, a medium temperature (MT) evaporator unit 104, a low temperature (LT) evaporator unit 106, a MT compressor unit 108, a LT compressor unit 110, a parallel compressor unit 112, a heat exchanger 114, a gas cooler 116, an expansion valve 118, a flash tank 120, a plurality of valves (e.g., at least a first valve 122, a second valve 124, a third valve 126, a fourth valve 128, a fifth valve 130, a sixth valve 132, a seventh valve 138, an eight valve 140, a ninth valve 144, and a tenth valve 146), and a controller 134. In some embodiments, the refrigeration system 100 is a transcritical refrigeration system that circulates a transcritical refrigerant such as $CO_2$.

Refrigeration conduit subsystem 102 facilitates the movement of refrigerant (e.g., $CO_2$) through a refrigeration cycle such that the refrigerant flows in the refrigeration mode as illustrated by arrows in FIG. 1. The refrigerant conduit subsystem 102 includes any conduit, tubing and the like that is illustrated in FIG. 1 fluidly connecting components of the refrigeration system 100.

In some embodiments, the MT compressor unit 108 is fluidly coupled to the refrigerant conduit subsystem 102. The MT compressor unit 108 includes one or more compressor(s) that is configured to compress (i.e., increase the pressure) of the refrigerant. The one or more compressor(s) of the MT compressor unit 108 is in signal communication with controller 134 using wired and/or wireless connection. The controller 134 provides commands and/or signals to control operation of the one or more compressor(s) of the MT compressor unit 108. For example, the controller 134 may provide signals to instruct the one or more compressor(s) to operate at a predetermined compressor speed. The one or more compressor(s) of the MT compressor unit 108 may vary by design and/or capacity. For example, some compressor designs may be more energy efficient than other compressor designs, and the one or more compressor(s) of the MT compressor unit 108 may have modular capacity (e.g., a capability to vary capacity).

In some embodiments, valve 128 is configured to receive refrigerant (e.g., from the MT compressor unit 108 and the parallel compressor unit 112) and is fluidly coupled to the refrigerant conduit subsystem 102. The valve 128 is configured to regulate the flow rate of the refrigerant received from the MT compressor unit 108 and the parallel compressor unit 112 to the gas cooler 116. In some embodiments the valve 128 may be configured to divert a portion of the refrigerant from the MT compressor 108 to the heat exchanger 114, which will be described in greater detail below. The valve 128 may be in communication with controller 134 (e.g., via wired and/or wireless communication) to receive control signals for opening, closing, and/or to provide flow measurement signals corresponding to the rate of refrigerant flowing through the valve 128. In some embodiments, the valve 128 is a differential pressure valve. The refrigeration system 100 may include an optional bypass valve 130. The bypass valve 130 may be used during start-up, shutdown, or during subcritical operation. The bypass valve 130 is generally closed during transcritical operation.

In some embodiments, the gas cooler 116 is generally operable to receive refrigerant from the valve 128 or optional bypass valve 130 and is fluidly coupled to the refrigerant conduit subsystem 102. The gas cooler 116 is configured to apply a cooling stage to the received refrigerant. In some embodiments, gas cooler 116 is a heat exchanger comprising cooler tubes configured to circulate the received refrigerant and coils through which air is forced. Inside gas cooler 116, the coils may absorb heat from the refrigerant, thereby cooling the refrigerant. The gas cooler 116 may include a fan that transports the air through the coils. The fan may be in communication with the controller 134 (e.g., via wired and/or wireless communication) to receive control signals for turning the fan on, off, and for controlling the speed of the fan to regulate the flow of air through the coils.

Expansion valve 118 is configured to receive refrigerant from the gas cooler 116 and is fluidly coupled to the refrigerant conduit subsystem 102. The expansion valve 118 is configured to remove pressure from the refrigerant received from the gas cooler 116. The expansion valve 118 may be a valve such as an expansion valve or a flow control valve (e.g., a thermostatic expansion valve) or any other suitable valve for removing pressure from the refrigerant while, optionally, providing control of the flow rate of the refrigerant. The expansion valve 118 may be in communication with the controller 134 (e.g., via wired or wireless communication) to receive control signals for opening, closing, and/or to provide flow measurement signals corresponding to the flow rate of refrigerant through the expansion valve 118.

Flash tank 120 is configured to receive refrigerant from the expansion valve 118 and is fluidly coupled to the refrigerant conduit subsystem 102. The flash tank 120 is configured to separate the refrigerant into a vapor refrigerant and a liquid refrigerant. Typically, the vapor refrigerant collects near the top of the flash tank 120 and the liquid refrigerant is collected at the bottom of the flash tank 120. In some embodiments, the liquid refrigerant flows from flash tank 120 and provides cooling to MT evaporator unit 104 and LT evaporator unit 106. That is, the refrigerant conduit subsystem 102 may split and a portion of the liquid refrigerant flows from flash tank 120 to the MT evaporator unit 104 and a portion of the liquid refrigerant flows from the flash tank 120 to the LT evaporator unit 106.

When operated in refrigeration mode, the MT evaporator unit 104 is fluidly coupled to the refrigeration conduit subsystem 102 and receives cooled liquid refrigerant from the flash tank 120 and uses the cooled refrigerant to provide cooling. The MT evaporator unit 104 includes an evaporator 136 along with valves 138, 140 to facilitate operation of the MT evaporator unit 104 in the refrigeration mode. As an example, the evaporator 136 may be part of a refrigerated case and/or cooler for storing food and/or beverages that must be kept at a specified temperature. The refrigeration system 100 may include any number of MT evaporator units 104 with the same or similar configuration shown for the example MT evaporator unit 104.

When the MT evaporator unit 104 is operating in refrigeration mode, liquid refrigerant from flash tank 120 flows through expansion valve 138, where the pressure of the refrigerant is decreased, before it reaches the evaporator 136. Expansion valve 138 maybe the same as or similar to expansion valve 118 described above. Expansion valve 138 may be configured to achieve a pre-defined refrigerant temperature that flows into the evaporator 136 (e.g., about −6° C.). The expansion valve 138 and the valve 140 may be in communication with the controller 134 (e.g., via wired and/or wireless communication) to receive control signals for opening, closing, and/or for providing flow measurement signals corresponding to the flow rate of refrigerant through the valves 138, 140.

Refrigerant from the MT evaporator unit 104 is provided to the one or more MT compressor(s) 108 via the refrigeration conduit subsystem 102. As described above, the MT compressor(s) 108 compress refrigerant discharged from the MT evaporator unit 104 and may provide supplemental compression to refrigerant discharged from any LT evaporator unit 106, which will be described further below.

LT evaporator unit 106 is generally similar to MT evaporator unit 104 but configured to operate at lower temperatures (e.g., for deep freezing applications near about −30° C. or the like). When operated in refrigeration mode, the LP evaporator unit 106 receives cooled liquid refrigerant from the flash tank 120 and uses the cooled refrigerant to provide cooling. The LP evaporator unit 106 includes an evaporator 142 along with appropriate valves 144, 146 to facilitate operation of the LT evaporator unit 106. The refrigeration system 100 may include any appropriate number of LT evaporator units 104 with the same or similar configuration to that shown for the LT evaporator unit 104.

When the LT evaporator 106 is operating in refrigeration mode, liquid refrigerant received from flash tank 120 flows through expansion valve 144, where pressure of the refrigerant is decreased, before it reaches the evaporator 142. Expansion valve 144 may be the same as or similar to expansion valve 118 described above. The expansion valve 144 may be configured to achieve a pre-determined refrigerant temperature that flows into evaporator 142 (e.g., about −30° C.). The expansion valve 144 and the valve 146 may be in communication with the controller 134 (e.g., via wired and/or wireless communication) to receive control signals for opening, closing, and/or for providing flow measurement signals corresponding to the flow rate of refrigerant through the valves 144, 146.

Refrigerant from the LT evaporator 106 is provided to one or more LT compressor(s) 110 via the refrigerant conduit subsystem 102. In some embodiments, the LT compressor unit 110 is fluidly coupled to the refrigerant conduit subsystem 102 and configured to compress (i.e., increase the pressure) of the refrigerant. The one or more compressor(s) of the LT compressor unit 108 is in signal communication with controller 134 (e.g., using wired and/or wireless connection). The controller 134 provides commands and/or signals to control operation of the one or more compressor(s) of the LT compressor unit 106. For example, the controller 134 may provide signals to instruct the one or more compressor(s) to operate at a predetermined compressor speed. The one or more compressor(s) of the LT compressor unit 110 may vary by design and/or capacity. For example, some compressor designs may be more energy efficient than other compressor designs, and the one or more compressor(s) of the LT compressor unit 110 may have modular capacity (e.g., a capability to vary capacity).

The LT compressor(s) unit 110 may discharge refrigerant to a series of valves 122, 124, and 126 via the refrigeration conduit subsystem 102. Valve 124 is positioned between the LT compressor unit 110 and the heat exchanger 114 and is fluidly coupled to the refrigeration conduit subsystem 102. In some embodiments, the valve 124 is configured to regulate the flow rate of the refrigerant from the LT compressor unit 110 to the heat exchanger 114. In some embodiments, the valve 124 may be in communication with the controller 134 (e.g., via wired and/or wireless communication) to receive control signals for opening, closing, and/or to provide flow measurement signals corresponding to the flow rate of refrigerant. In some embodiments, the valve 124 is a check valve that restricts a backflow of the refrigerant from the heat exchanger 114 to the LT compressor unit 110.

The valve 122 is positioned between the LT compressor unit 110 and the MT compressor unit 108 and is fluidly coupled to the refrigeration conduit subsystem 102. In some embodiments, the valve 122 is configured to regulate the flow rate of the refrigerant from the LT compressor unit 110 to the MT compressor unit 108. In some embodiments, the valve 122 may be in communication with the controller 134 (e.g., via wired and/or wireless communication) to receive control signals for opening, closing, and/or to provide flow measurement signals corresponding to the flow rate of refrigerant. In some embodiments, the valve 122 is a differential pressure valve having a threshold pressure. The valve 122 is configured to, when the threshold pressure is exceeded, to direct the refrigerant from the LT compressor unit 110 to the MT compressor unit 108. When the refrigerant is below the threshold pressure, the valve 122 is configured to direct the refrigerant from the LT compressor unit 110 to the heat exchanger 114. As one non-limiting example, the threshold pressure of the valve 122 may be set to 479 psia and if the pressure of refrigerant discharged from the LT compressor unit 110 is below 479 psia then the refrigerant is directed from the LT compressor unit 110 to the heat exchanger 114. Conversely, if the pressure of the refrigerant discharge from the LT compressor unit 110 is above 479 psia then then the valve 122 allows the passage of the refrigerant from the LT compressor unit 110 to the MT compressor unit 108.

Valve 132 is positioned between the LT compressor unit 110 and the MT compressor unit 108 and is fluidly coupled to the refrigerant conduit subsystem 102. The valve 132 is an optional by-pass valve that is configured to regulate the flow rate of the refrigerant from the LT compressor unit 110 to the MT compressor unit 108. In some embodiments, the valve 132 may be in communication with the controller 134 (e.g., via wired and/or wireless communication) to receive control signals for opening, closing, and/or to provide flow measurement signals corresponding to the flow rate of refrigerant. In some embodiments, valve 132 is used during when the system 100 is operating in subcritical operation (e.g., little or no vapor refrigerant is produced in flash tank 120) and may be opened so that the refrigerant can bypass the heat exchanger 114. However, during normal transcritical operation (e.g., vapor refrigerant is being produced in flash tank 120), the valve 132 is typically closed. The controller 134 may detect when the system 100 is operating in subcritical or transcritical operation and adjust bypass valves 130 and 132 accordingly.

Heat exchanger 114 is fluidly coupled to the refrigeration conduit subsystem 102 and is configured to receive a portion of the refrigerant from the LT compressor unit 110 and a portion of the refrigerant from the MT compressor unit 108. The heat exchanger 114 is configured to transfer heat from the portion of the refrigerant received from the MT compressor unit 108 to the portion of refrigerant received from the LT compressor unit 110 thereby producing a heated refrigerant stream that is received by valve 126 and a cooled refrigerant stream that is received by gas cooler 116 via the refrigeration conduit subsystem 102. Heat exchanger 114 may be any heat exchanger that allows heat transfer between the respective refrigerant streams received from the LT compressor unit 110 and the MT compressor unit 108 (e.g., shell and tube heat exchanger, double pipe heat exchanger, plate heat exchanger, etc.). In some embodiments, the heat exchanger 114 isochorically compresses the portion of the refrigerant received from the LT compressor unit 110 to produce the heated refrigerant stream. For example, in some embodiments, the heat exchanger 114 traps the refrigerant from the LT compressor unit 110 with the help of the valve 124 in its upstream and the valve 126 in its downstream, and increases the pressure of the refrigerant by increasing the temperature of the refrigerant and keeping the volume of the refrigerant constant.

Valve 126 is positioned between the heat exchanger 114 and the parallel compressor unit 112 and is fluidly coupled to the refrigeration conduit subsystem 102. The valve 126 is configured to regulate the flow rate of the heated refrigerant from the heat exchanger 114 to the parallel compressor unit 112. In some embodiments, the valve 126 may be in communication with the controller 134 (e.g., via wired and/or wireless communication) to receive control signals for opening, closing, and/or to provide flow measurement signals corresponding to the flow rate of refrigerant. In some embodiments, the valve 126 is a differential pressure valve having a threshold pressure. The valve 126 is configured to, when the threshold pressure is exceeded, to allow the passage of the heated refrigerant from the heat exchanger 114 to the parallel compressor unit 112 and, when the heated refrigerant is below the threshold pressure, the valve 126 restricts the flow of the heated refrigerant from the heat exchanger 114 to the parallel compressor unit 112. The threshold pressure of the valve 126 may be selected such that the pressure of the heated stream substantially matches the pressure of the vapor refrigerant discharged from the flash tank 120. As used herein, "substantially matches" may refer to a pressure value that is within ±15%, ±10%, ±5%, or ±1% of the respective streams.

As one non-limiting example, the pressure of the vapor refrigerant discharged from the flash tank 120 may be 529 psia and the threshold pressure of the valve 126 may be set to 563 psia. If the heated refrigerant from the heat exchanger 114 exceeds 563 psia, the valve 126 allows the passage of the heated refrigerant such that it is combined with the vapor refrigerant from the flash tank 120 prior to being received by the parallel compressor unit 112. If the heated refrigerant from the heat exchanger 114 is below 563 psia, the valve restricts the flow of heated refrigerant from the heat exchanger 114 to the parallel compressor unit 112.

In some embodiments, the parallel compressor unit 112 is fluidly coupled to the refrigerant conduit subsystem 102. The parallel compressor unit 112 includes one or more compressor(s) that is configured to compress (i.e., increase the pressure) of the refrigerant received from the flash tank 120 and the heat exchanger 114. The parallel compressor unit 112 discharges the refrigerant such that it is combined with the refrigerant discharged from the MT compressor unit 108. Valve 128 then regulates the flow rate of the combined refrigerant from the MT compressor unit 108 and the parallel compressor unit 112 to the gas cooler 116 and the heat exchanger 114, as described above. The one or more compressor(s) of the parallel compressor unit 112 is in signal communication with controller 134 using wired and/or wireless connection. The controller 134 provides commands and/or signals to control operation of the one or more compressor(s) of the parallel compressor unit 112. For example, the controller 134 may provide signals to instruct the one or more compressor(s) to operate at a predetermined compressor speed. The one or more compressor(s) of the parallel compressor unit 112 may vary by design and/or capacity. For example, some compressor designs may be more energy efficient than other compressor designs, and the one or more compressor(s) of the parallel compressor unit 112 may have modular capacity (e.g., a capability to vary capacity).

The controller 134 includes a processor 148, an input/output (I/O) interface 150, and a memory 152. The processor 148 is any electronic circuitry including, but not limited to, state machines, one or more central processing unit (CPU) chips, logic units, cores (e.g., a multi-core processor), field-programmable gate array (FPGAs), application specific integrated circuits (ASICs), or digital signal processors (DSPs) that communicatively couples to memory 160 and controls the operation of refrigeration system 100. The processor 148 may be a programmable logic device, a microcontroller, a microprocessor, or any suitable combination of the preceding. The processor 148 is communicatively coupled to and in signal communication with the memory 152. The one or more processors are configured to process data and may be implemented in hardware or software. For example, the processor 148 may be 8-bit, 16-bit, 32-bit, 64-bit or of any other suitable architecture. The processor 148 may include an arithmetic logic unit (ALU) for performing arithmetic and logic operations, processor registers that supply operands to the ALU and store the results of ALU operations, and a control unit that fetches instructions from memory 152 and executes them by directing the coordinated operations of the ALU, registers, and other components. The processor 148 may include other hardware and software that operates to process information, control the refrigeration system 100, and perform any of the functions described herein. The processor 148 is not limited to a single processing device and may encompass multiple processing devices.

The memory 152 includes one or more disks, tape drives, or solid-state drives, and may be used as an over-flow data storage device, to store programs when such programs are selected for execution, and to store instructions and data that are read during program execution. The memory 152 may be volatile or non-volatile and may comprise ROM, RAM, ternary content-addressable memory (TCAM), dynamic random-access memory (DRAM), and static random-access memory (SRAM). The memory 152 is operable to store any suitable set of instructions, logic, rules, and/or code for executing the functions described in this disclosure. For example, the memory 152 may store compressor operating instructions 154. The operating instructions 154 may be instructions for operating one or more of the components in communication with the controller 134, such as the MT evaporator unit 104, LT evaporator unit 106, MT compressor unit 108, LT compressor unit 110, parallel compressor unit 112, gas cooler 116, and the valves in the system (e.g., 118, 122, 124, 126, 128, 130, 132, 138, 140, 144, 146). The memory 152 may also include pressure thresholds 156 for the differential pressure valves 122 and 126.

The I/O interface 150 is configured to communicate data and signals with other devices. For example, the I/O interface 150 may be configured to communicate electrical signals with the other components of the refrigeration system 100. The I/O interface 150 may comprise ports and/or terminals for establishing signal communications between the controller 134 and other devices. The I/O interface 150 may be configured to enable wired and/or wireless communications. Connections between various components of the refrigeration system 100 and between components of system 100 may be wired or wireless. For example, conventional cable and contacts may be used to couple the various components described above. In some embodiments, a wireless connection is employed to provide at least some of the connections between components of the refrigeration system 100. In some embodiments, a data bus couples various components of the refrigeration system 100 together such that data is communicated there between. In a typical embodiment, the data bus may include, for example, any combination of hardware, software embedded in a computer readable medium, or encoded logic incorporated in hardware or otherwise stored (e.g., firmware) to couple components of refrigeration system 100 to each other.

As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 134 to other components of the refrigeration system 100.

In some embodiments, the controller 134 is configured to execute operating instructions 154 to the various components in the refrigeration system 100. For example, the controller 134 is configured to compress a refrigerant received from the MT evaporator unit 104 using the MT compressor unit 108. The controller 134 is configured to compress the refrigerant received from the LT evaporator unit using the LT compressor unit 110, and transfer heat from a portion of the refrigerant provided by the MT compressor unit 108 to a portion of the refrigerant provided by the LT compressor unit 110 using the heat exchanger 114 to produce a heated refrigerant stream and a cooled refrigerant stream.

The controller 134 is further configured to combine the heated refrigerant stream from the heat exchanger 114 with a vapor refrigerant stream from the flash tank 120 by regulating the flow rate using valve 126. The valve 126 may block the flow of the heated refrigerant stream and increase the pressure of the heated refrigerant stream such that the pressure of the heated refrigerant stream substantially matches the pressure of the vapor refrigerant stream. The controller 134 is further configured to compress the heated refrigerant stream and the vapor refrigerant stream in the parallel compressor unit 112 and combine the refrigerant from the parallel compressor unit 112 with the refrigerant from the MT compressor unit 108. In some embodiments, the controller 134 is configured to transfer a portion of the refrigerant from the parallel compressor unit 112 and the MT compressor unit 108 to the gas cooler 116 and recycle a portion of the refrigerant from the parallel compressor unit 112 and the MT compressor unit 108 to the heat exchanger 114. The controller 134 is configured to regulate the flow rate of the refrigerant to the gas cooler 116 and the recycled refrigerant to heat exchanger 114 using valve 128.

Example Method of Operation

FIG. 2 illustrates an example method 200 of operating the refrigeration system 100 described in FIG. 1. The method 100 may be implemented using processor 148, the input/output (I/O) interface 150, and the memory 152. The method 200 may begin at operation 202, which includes cooling a refrigerant using a gas cooler 116. At operation 204, the method includes decreasing the pressure of the refrigerant from the gas cooler 116 using the expansion valve 118.

At operation 206, the method 200 includes separating the refrigerant provided by the expansion valve 118 into a vapor refrigerant and a liquid refrigerant using a flash tank 120. At operational block 208, the method 200 includes deciding whether to cool a MT space and/or a LT space. If it is determined that a MT space should be cooled, the method 200 proceeds to operation 210. Operation 210 includes transferring a portion of the liquid refrigerant from the flash tank 120 to a MT evaporator unit 104 and cooling the MT space using the MT evaporator unit 104. At operation 212, the method 200 includes compressing the refrigerant from the MT evaporator unit 104 using the MT compressor unit 108.

Referring back to operational block 208, if it is determined that a LT space should be cooled, the method 200 proceeds to operation 214. At operation 214, the method 200 includes transferring a portion of the liquid refrigerant from the flash tank 120 to a LT evaporator unit 214 and cooling the LT space using the LT evaporator unit 106. At operation 216, the method 200 includes compressing the refrigerant from the LT evaporator unit 106 using the LT compressor unit 110.

At operational blocks 218 and 220, the method 200 includes determining if heat exchange should occur in heat exchanger 114 for the refrigerant compressed by the MT compressor unit 108 and the LT compressor unit 110, respectively. If it is determined at operational blocks 218 and 220 that heat exchange should not occur, the method 200 at operational block 220 includes transferring the refrigerant compressed by the LT compressor unit 110 to the MT compressor unit 108 for further compression, where operation 212 may be repeated. Valve 124 may direct the refrigerant from the LT compressor unit 110 to the MT compressor unit 108, as described above. With respect to operational block 218, if it is determined that heat transfer should not occur, the method 200 includes transferring the refrigerant compressed by the MT compressor unit 108 to the gas cooler 116, where operation 202 may be repeated.

If it is determined that heat exchange should occur in operational blocks 218 and 220, the method 200 proceeds to operation 222. Operation 222 includes transferring heat from a portion of the refrigerant provided by the MT compressor unit 108 to a portion of the refrigerant provided by the LT compressor unit 110 using the heat exchanger 114 to produce a heated refrigerant stream and a cooled refrigerant stream. In some embodiments, the method 200 includes isochorically transferring heat using the heat exchanger 114.

At operation block 224, the method 200 includes transferring the cooled refrigerant stream provided by the heat exchanger 114 to the gas cooler 116 for further processing, which may include repeating operation 202. At operation block 224, the method 200 includes proceeding to operation 226, which includes combining the heated refrigerant stream from the heat exchanger 114 with the vapor refrigerant stream from the flash tank 120. Valve 126 may be used such that the pressure of the heated refrigerant stream substantially matches the pressure of the vapor refrigerant stream. At operation 228, the method 200 includes compressing the heated refrigerant and the vapor refrigerant in a parallel compressor unit 112. At operation 230, the method 200 includes combining the refrigerant provided by the parallel compressor unit 112 with the refrigerant compressed by the MT compressor unit 108. At operation 230, a portion of the combined refrigerant provided by the parallel compressor unit 112 and the MT compressor unit 108 is transferred to the gas cooler 116, and a portion of the combined refrigerant provided by the parallel compressor unit 112 and the MT compressor unit 108 is recycled to the heat exchanger 114 for further heat transfer. At operation block 232, a determination is made if further cooling is needed for the MT space and/or the LT space. If it is determined that no further cooling is needed to the MT space or the LT space, then the method 200 may end. For example, the MT space or the LT space may be at a desired temperature. If it is determined that further cooling is needed, the method 200 may be repeated starting with operation 202. While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. A refrigeration system, comprising:

a medium temperature (MT) evaporator unit configured to receive refrigerant, the MT evaporator unit comprising a MT expansion valve and a MT evaporator; wherein the MT expansion valve is configured to decrease the pressure of the refrigerant and the MT evaporator unit is configured to cool a MT space;

a low temperature (LT) evaporator unit configured to receive a portion of the refrigerant, the LT evaporator unit comprising a LT expansion valve and a LT evaporator, wherein the LT expansion valve is configured to decrease the pressure of the refrigerant and the LT evaporator unit is configured to cool a LT space;

a MT compressor unit that receives the refrigerant from the MT evaporator unit, the MT compressor unit comprising at least one MT compressor that is configured to compress the refrigerant;

a LT compressor unit configured to receive the refrigerant from the LT evaporator unit, the LT compressor unit comprising at least one LT compressor configured to compress the refrigerant;

a heat exchanger that receives a portion of the refrigerant from the LT compressor unit and a portion of the refrigerant from the MT compressor unit, the heat exchanger configured to transfer heat from the portion of the refrigerant received from the MT compressor unit to the portion of the refrigerant received from the LT compressor unit thereby producing a heated refrigerant stream and a cooled refrigerant stream;

a gas cooler configured to receive the refrigerant from the MT compressor unit, the gas cooler configured to cool the refrigerant, wherein the gas cooler is configured to receive the cooled refrigerant stream from the heat exchanger;

an expansion valve configured to receive the refrigerant from the gas cooler, the expansion valve configured to decrease a pressure of the refrigerant; and a flash tank configured to receive the refrigerant from the expansion valve, the flash tank configured to separate the refrigerant into a vapor refrigerant and a liquid refrigerant, wherein the MT evaporator unit is configured to receive at least a portion of the liquid refrigerant, and wherein the LT evaporator unit is configured to receive at least a portion of the liquid refrigerant.

2. The refrigeration system of claim 1, wherein the heat exchanger isochorically compresses the portion of the refrigerant received from the LT compressor unit to produce the heated refrigerant stream.

3. The refrigeration system of claim 1 further comprising:

a first valve positioned between the LT compressor unit and the heat exchanger, wherein the first valve is configured to regulate the flow rate of the refrigerant from the LT compressor unit to the heat exchanger; and a second valve positioned between the LT compressor unit and the MT compressor unit, wherein the second valve is configured to regulate the flow rate of the refrigerant from the LT compressor unit to the MT compressor unit.

4. The refrigeration system of claim 3, wherein the first valve is a check valve, wherein the check valve restricts a backflow of the refrigerant from the heat exchanger to the LT compressor unit.

5. The refrigeration system of claim 3, wherein the second valve is a differential pressure valve having a threshold pressure, wherein, when the threshold pressure is exceeded, the differential pressure valve is configured to direct the refrigerant from the LT compressor unit to the MT compressor unit and, when the refrigerant is below the threshold pressure, the differential pressure valve is configured to direct the refrigerant from the LT compressor unit to the heat exchanger.

6. The refrigeration system of claim 1, further comprising:

a parallel compressor unit configured to receive the vapor refrigerant from the flash tank and the heated refrigerant stream from the heat exchanger;

a valve positioned between the heat exchanger and the parallel compressor, wherein the valve is configured to regulate the flow rate of the heated refrigerant from the heat exchanger to the parallel compressor.

7. The refrigeration system of claim 1, wherein the valve positioned between the heat exchanger and the parallel compressor unit is a differential pressure valve having a threshold pressure, wherein, when the threshold pressure is exceeded, the differential pressure valve allows the passage of the heated refrigerant from the heat exchanger to the parallel compressor unit and, when the heated refrigerant is below the threshold pressure, the differential pressure valve restricts the flow of the heated refrigerant from the heat exchanger to the parallel compressor unit.

8. The refrigeration system of claim 1, further comprising:

a valve positioned between the MT compressor unit and the gas cooler, wherein the valve is configured to divert the portion of the refrigerant from the MT compressor to the heat exchanger.

9. A refrigeration system, comprising:

a heat exchanger configured to receive a portion of refrigerant from a low temperature (LT) compressor unit and a portion of refrigerant from a medium temperature (MT) compressor unit, wherein the heat exchanger is configured to transfer heat from the portion of the refrigerant received from the MT compressor unit to the portion of the refrigerant received from the LT compressor unit thereby producing a heated refrigerant stream and a cooled refrigerant stream;

a first valve positioned between the LT compressor unit and the heat exchanger, wherein the first valve is configured to regulate the flow rate of the refrigerant from the LT compressor unit to the heat exchanger;

a second valve positioned between the LT compressor unit and the MT compressor unit, wherein the second valve is configured to regulate the flow rate of the refrigerant from the LT compressor unit to the MT compressor unit;

a parallel compressor unit configured to receive the heated refrigerant stream from the heat exchanger and to receive a vapor refrigerant from a flash tank; and a third valve positioned between the heat exchanger and the parallel compressor unit, wherein the third valve is configured to regulate the flow rate of the heated refrigerant from the heat exchanger to the parallel compressor.

10. The refrigeration system of claim 9, wherein the heated refrigerant stream is configured to be combined with the vapor refrigerant stream provided by the flash tank prior to being received by the parallel compressor.

11. The refrigeration system of claim 9, wherein the first valve is a check valve, wherein the check valve restricts a backflow of the refrigerant from the heat exchanger to the LT compressor unit.

12. The refrigeration system of claim 9, wherein the second valve is a differential pressure valve having a threshold pressure, wherein, when the threshold pressure is exceeded, the differential pressure valve is configured to direct the refrigerant from the LT compressor unit to the MT compressor unit and, when the refrigerant is below the threshold pressure, the differential pressure valve is configured to direct the refrigerant from the LT compressor unit to the heat exchanger.

13. The refrigeration system 11, wherein the third valve positioned between the heat exchanger and the parallel compressor unit is a differential pressure valve having a threshold pressure, wherein, when the threshold pressure is exceeded, the differential pressure valve allows the passage of the heated refrigerant from the heat exchanger to the parallel compressor unit and, when the heated refrigerant is below the threshold pressure, the differential pressure valve restricts the flow of the heated refrigerant from the heat exchanger to the parallel compressor unit.

14. A method of operating a refrigeration system, the method comprising:

compressing a refrigerant received from a medium temperature (MT) evaporator unit using a MT compressor unit, the MT compressor unit comprising at least one MT compressor;

compressing the refrigerant received from a low temperature (LT) evaporator unit using a LT compressor unit, the LT compressor unit comprising at least one LT compressor;

transferring heat from a portion of the refrigerant provided by the MT compressor unit to a portion of the refrigerant provided by the LT compressor unit using a heat exchanger to produce a heated refrigerant stream and a cooled refrigerant stream;

combining the heated refrigerant stream from the heat exchanger with a vapor refrigerant stream provided from a flash tank; and compressing the heated refrigerant stream and the vapor refrigerant stream in a parallel compressor unit, the parallel compressor unit comprising at least one compressor.

15. The method of claim 14 further comprising isochorically transferring heat using the heat exchanger to produce the heated refrigerant stream and the cooled refrigerant stream.

16. The method of claim 14 further comprising:

reducing the pressure of the heated refrigerant stream using a valve such that a pressure of the heated refrigerant stream substantially matches a pressure of the vapor refrigerant stream.

17. The method of claim 14 further comprising:

combining the refrigerant provided from the parallel compressor unit with the refrigerant from the MT compressor unit;

transferring a portion of the refrigerant from the parallel compressor unit and the MT compressor unit to a gas cooler, wherein the gas cooler is configured to cool the portion of the refrigerant received from the parallel compressor unit and the MT compressor unit; and recycling a portion of the refrigerant from the parallel compressor unit and the MT compressor unit to the heat exchanger, wherein the recycled refrigerant is configured to transfer heat to the portion of the refrigerant provided by the LT compressor unit in the heat exchanger.

* * * * *